US006328555B1

(12) United States Patent
Park

(10) Patent No.: US 6,328,555 B1
(45) Date of Patent: Dec. 11, 2001

(54) LIGHTER WITH SAFETY DEVICE

(75) Inventor: Kyunghan Park, Seoul (KR)

(73) Assignee: Kyunghan Park, Seol (KR)

( * ) Notice: Subject to any disclaimer, the term of this patent is extended or adjusted under 35 U.S.C. 154(b) by 0 days.

(21) Appl. No.: 09/709,308

(22) Filed: Nov. 13, 2000

(51) Int. Cl.[7] ..... F23D 11/36
(52) U.S. Cl. ..... 431/153; 431/152; 431/255
(58) Field of Search ..... 431/129, 130, 431/131, 142–144, 150–153, 255, 277

(56) References Cited

U.S. PATENT DOCUMENTS 3,328,980 * 7/1967 Reim ..... 431/153
4,102,633 * 7/1978 Zellweger et al. ..... 431/152
4,403,945 * 9/1983 Leitgib ..... 431/150
5,401,163 * 3/1995 Yamazaki ..... 431/152

* cited by examiner

*Primary Examiner*—James C. Yeung
(74) *Attorney, Agent, or Firm*—McGuireWoods LLP

(57) ABSTRACT

A gas lighter which is ignited only when the cap is open and a safety switch is released and when the cap is closed, it is automatically locked again, and of which the nozzle is open, whenever the cap is open and even when the cap is open, the gas does not flow out through the nozzle and just when the safety switch is adjusted to lift the nozzle, and then the nozzle is finally open.

10 Claims, 3 Drawing Sheets

LIGHTER WITH SAFETY DEVICE

FIELD OF THE INVENTION

The present invention is related to a gas lighter which has a safety device, and more particularly to a gas lighter which is ignited only when the cap is open and a safety switch is released. When the cap is closed, the safety device is automatically locked again.

BACKGROUND OF THE INVENTION

The prior system has a safety device which is ignited when the nozzle is open by working of the lever. When the lever is taken off, the nozzle is automatically choked up to turn the light off. However, when the cap is open it may cause an accident due to carelessness. This is because the gas lighter, using a wheel, is ignited depending on whether the nozzle is open or not. Thus, the gas lighter using a wheel without a cap has a lever in front of the lower part of the wheel, so that the gas flows out, only when the lever is pressed at the same time when the wheel is turned.

Nevertheless, no safety device has been designed for this kind of gas lighter. Thus there always remains a chance of an accident occurring.

SUMMARY OF THE INVENTION

The present invention is provided in order to solve the above problem of the prior art of which the nozzle is open, whenever the cap is open. That is, even when the cap is open, the present invention does not allow gas to flow out through the nozzle. Gas can flow when the safety switch is adjusted to lift the nozzle, and then the nozzle is finally open.

As described above, the present invention is devised to prevent the gas from flowing out by means of when the safety switch is not working. The safety switch is automatically returned to the normal state when the cap is closed.

BRIEF DESCRIPTION OF THE ATTACHED DRAWINGS

DETAILED DESCRIPTION OF PREFERRED EMBODIMENT

The following is the detailed description of the most desirable embodiment of the present invention. The most desirable embodiment of this invention will be described in detail according to the attached drawings. The same reference numbers will be used to designate the same drawing elements regardless of different drawings.

Figure 1:
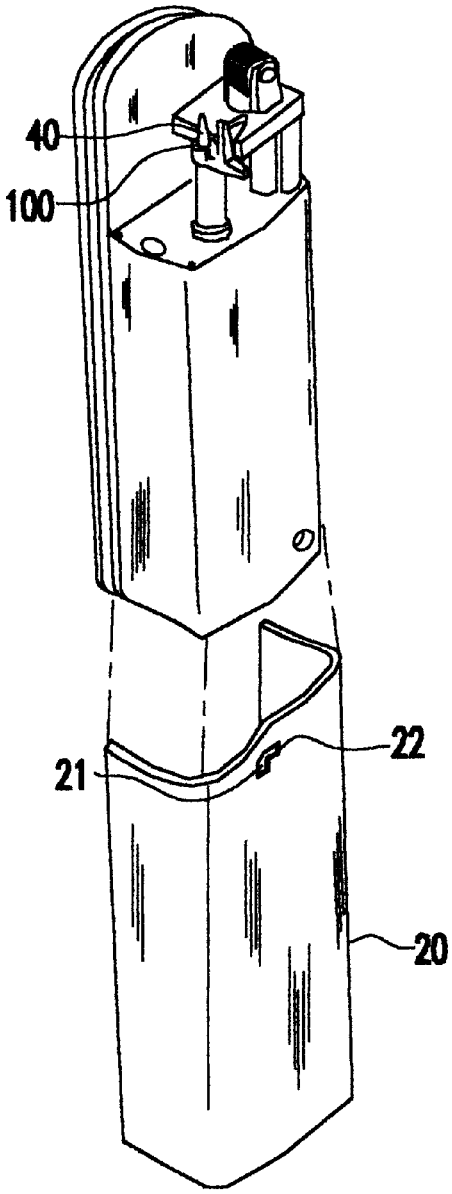
FIG. 1 is a perspective view showing installing the safety switch in the nozzle of the present invention.
Figure 2:
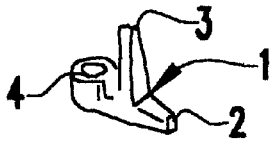
FIG. 2 is a perspective view showing that the opening lever and closing lever are formed in the safety switch of the present invention.
Figure 3:
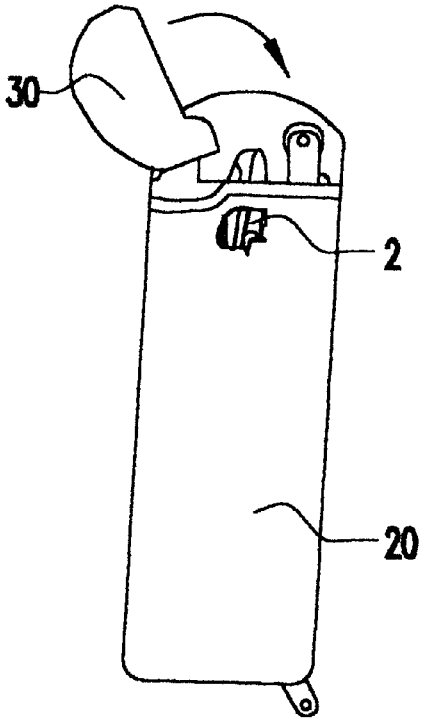
FIG. 3 is a perspective view showing that the opening lever is working on the body of the present invention.
Figure 4:
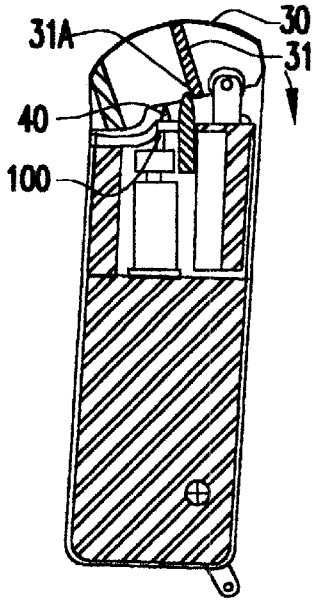
FIG. 4 is a sectional view showing that the closing lever is stuck to the sliding protrusion of the cap.
Figure 5:
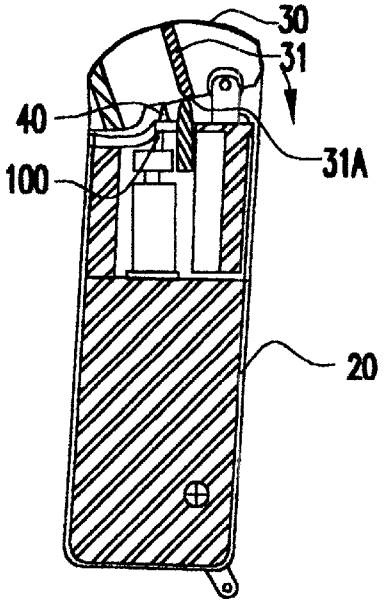
FIG. 5 is a sectional view showing that the sliding protrusion is inserted in and out of the perforation in the body of the present invention.

As shown in FIGS. 1 and 2, the opening lever (2) and the closing lever (3) are formed at a right angle to each other. A safety switch (1), which is a ring (4), is formed on the opening lever (2) and is fixed on the nozzle (40) by the ring (4). Under the above position, the closing lever (3) of the safety switch (1) is inserted into a perforation ( 11) of the body (10), which has a cap (30), so that the closing lever (3) is stuck to the sliding protrusion (31) when the cap (30) is open or closed. And, the opening lever (2) is inserted into a front hole (21) which is formed at the forward part of the body cover (20). When the opening lever, inserted into the front hole (21), is forced upward and positioned on a sill (22), the nozzle (40) remains open for a moment. And, when the cap (30) is closed, the sliding protrusion (31) of the cap (30) is stuck to the closing lever (3) of the safety switch (1) so that the nozzle (40) is automatically closed by each sliding facet **(3*a*, 3*a*). Also the nozzle is closed by the safety switch (1) positioned on the sill (22) of the front hole (21) by the opening lever (2)**.

At this point, the forward part of the closing lever (3) of the safety switch (1), which faces with the sliding protrusion (31) of the cap (30), is slightly sloped in order that it is easy to be stuck to each other. On the other hand, the sliding protrusion (31) of the cap (30) of the present invention is lengthened toward the inside so that after the closing lever (3) of the safety switch (1) is not protruded out of the perforation (11) of the body (10), the perforation (11) of the body (10) is made large and the closing lever (3) is inserted into it.

Figure 6:
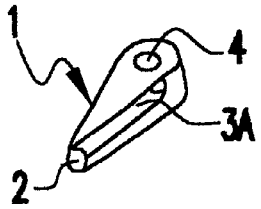
FIG. 6 is a perspective view of another embodiment of the safety switch of the present invention.
Figure 7:
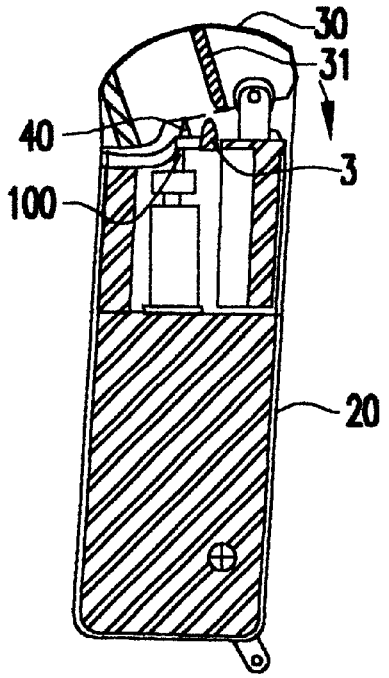
FIG. 7 is a cross sectional view showing an operational state of FIG. 6.
Figure 8:
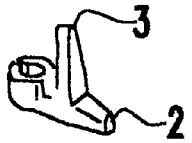
FIG. 8 is a perspective view of another embodiment of the ring of the safety switch.
Figure 9:
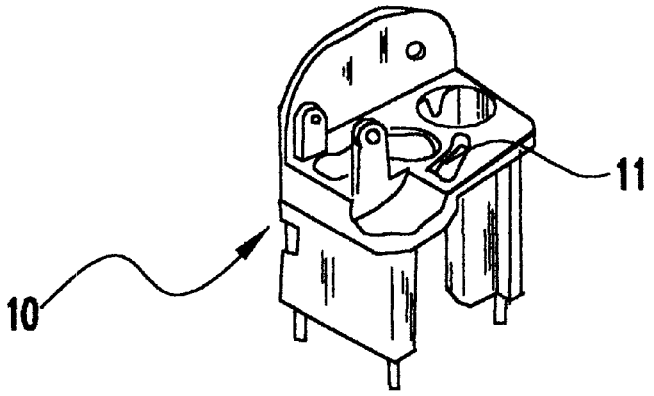
FIG. 9 is a perspective view showing the outer appearance of the body.

Furthermore, in FIG. 6, the closing lever (3) is not formed on the safety switch (1). In this embodiment, after the opening lever is inclined, the sliding protrusion (31), which is formed on the cap (30), is inserted into the perforation (11) (FIG. 9), and is facing the inclined facet of the opening lever (2), the opening lever is forced off from the sill of the front hole (21) and returns to the original state.

In addition, the ring is made open for one side, so that it has an elasticity, and a washer or snap-ring (100) can be used for fixing the nozzle more tightly. Therefore, when the nozzle (40) is not lifted up, even if the cap (30) is open, the gas does not flow out. And although the cap (30) is closed, the safety switch (1) does not work because the sliding protrusion (31) is stuck to the closing lever (3) or facets. And when the opening lever (2) is forced upward and positioned on the sill (22), which is formed on the front hole (21) in order to use the lighter, the nozzle (40) remains open in a moment, and the gas flows and the lighter is ignited by turning the wheel.

At this point, when the cap (30) is closed after using, the closing lever (3) or a facet is stuck to the sliding protrusion (31) of the cap (30) so that the safety switch (1) is automatically returned to the normal state when the cap (30) is closed.

What is claimed is:

1. A gas lighter which has a safety device comprising:

a safety switch having a ring in which a nozzle of the gas lighter is inserted therein, an opening lever extending from the ring and adapted to protrude from a front hole of a body cover of the gas lighter, and a closing lever positioned proximate to the opening lever and which is adapted to contact a sliding protrusion of a cap and is inserted into a perforation of a body of the gas lighter.

2. A gas lighter which has a safety device as claimed in the claim 1, wherein, the closing lever is not protruded out of the body and the sliding protrusion of the cap is lengthened, so that it inserted into the perforation of the body.

3. A gas lighter which has a safety device as claimed in the claim 2, wherein, the closing lever and the sliding protrusion of the cap, which is faced with the closing lever, both of them have a sliding facet, so to be stuck to each other.

4. A gas lighter which has a safety device as claimed in the claim 1, wherein, the sliding protrusion is faced with the opening lever of the safety switch, which is not formed a closing lever, when the sliding protrusion is lengthened and inserted into the perforation of the body.

5. A gas lighter which has a safety device as claimed in the claim 1, wherein the closing lever and the sliding protrusion of the cap, which is faced with the closing lever, both of them have a sliding facet, so to be stuck to each other.

6. A gas lighter which has a safety device as claimed in the claim 4, wherein the opening lever and the sliding protrusion of the cap, which is faced with the closing lever, both have a sliding facet so to be stuck to each other.

7. A gas lighter which has a safety device, as claimed in claim 4, wherein, the ring of the safety switch is made open for one side.

8. A gas lighter which has a safety device, as claimed in claim 1, wherein, the ring of the safety switch is made open for one side.

9. A gas lighter having a safety device comprising:

a body having a perforation;

a body cover fitting over the body, the body cover having a front hole disposed therein;

a cap position over the body cover and adapted to open and close, the cap including a sliding protrusion;

a safety switch having a ring which is adapted to fit over a nozzle of the gas lighter;

an opening lever extending from the ring and adapted to protrude from the front hole of the body cover; and a closing lever associated with the opening lever and which is adapted to contact the sliding protrusion of the cap and insertable into the perforation.

10. The gas lighter as claimed in claim 9, wherein the closing lever extends perpendicular from the opening lever on the safety switch.

* * * * *